US012258954B2

(12) United States Patent
Melo et al.

(10) Patent No.: US 12,258,954 B2
(45) Date of Patent: Mar. 25, 2025

(54) CONTINUOUS MAGNETIC POSITIVE DISPLACEMENT PUMP

(71) Applicant: Saudi Arabian Oil Company, Dhahran (SA)

(72) Inventors: Rafael Adolfo Lastra Melo, Dhahran (SA); Faris Hasan Tulbah, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 554 days.

(21) Appl. No.: 17/551,388

(22) Filed: Dec. 15, 2021

(65) Prior Publication Data

US 2023/0184234 A1 Jun. 15, 2023

(51) Int. Cl.
*F04B 47/00* (2006.01)
*E21B 43/12* (2006.01)
(Continued)

(52) U.S. Cl.
CPC ..... *F04B 47/00* (2013.01); *E21B 43/128* (2013.01); *F04B 7/0076* (2013.01);
(Continued)

(58) Field of Classification Search
CPC ..... F04B 17/044; F04B 17/046; F04B 47/00; F04B 53/1082; F04B 53/125;
(Continued)

(56) References Cited

U.S. PATENT DOCUMENTS 646,887 A 4/1900 Stowe et al.
2,295,944 A 9/1942 Fitzsimmons
(Continued)

FOREIGN PATENT DOCUMENTS

CN 202851445 4/2013
CN 103185025 7/2013
(Continued)

OTHER PUBLICATIONS

Simpson, "A Tough, Truly Multiphase Downhole Pump for Unconventional Wells," SPE-185152-MS, Society for Petroleum Engineers (SPE), SPE Electric Submersible Pump Symposium, Apr. 24-28, 2017, 20 pages.
(Continued)

*Primary Examiner* — Kenneth J Hansen
*Assistant Examiner* — Chirag Jariwala
(74) *Attorney, Agent, or Firm* — Fish & Richardson P.C.

(57) ABSTRACT

A downhole magnetic pump system includes a tube positioned within a wellbore at least partially filled with a fluid. A conductive wire coil is helically wrapped around the tube and is configured to generate a magnetic field in response to an electrical current passing through the coil. A standing valve assembly including a one-way valve and a travelling valve assembly also including a one-way valve are both positioned in the tube, with the travelling valve assembly positioned uphole of the standing valve assembly. The traveling valve is configured to repetitively cycle between a first position uphole of the standing valve assembly and a second position uphole of the first position in response to the electrical current repetitively switching between a first state to a second state. In this way, a portion of the fluid is displaced in an uphole direction.

24 Claims, 9 Drawing Sheets

(51) Int. Cl.
*F04B 7/00* (2006.01)
*F04B 17/04* (2006.01)
*F04B 53/10* (2006.01)
*F04B 53/12* (2006.01)

(52) U.S. Cl.
CPC ..... *F04B 17/046* (2013.01); *F04B 53/1082* (2013.01); *F04B 53/125* (2013.01)

(58) Field of Classification Search
CPC ..... F04B 53/126; F04B 7/0076; F04B 47/06; E21B 34/066; E21B 34/16; E21B 43/126; E21B 43/128; E21B 43/121; F16K 15/18; F16K 15/182; F16K 15/1823; F16K 15/184; F16K 15/1843; F16K 27/00; F16K 27/0209; F16K 27/0281; F16K 27/029; F16K 2200/50–502; Y10T 137/7854
USPC ..... 137/515
See application file for complete search history.

(56) References Cited

U.S. PATENT DOCUMENTS 2,641,191 A 6/1953 Alfred
2,782,720 A 2/1957 Dochterman
2,845,869 A 8/1958 Herbenar
3,038,698 A 6/1962 Troyer
3,075,743 A 1/1963 Sheets
3,433,163 A 3/1969 Brancart
4,139,330 A 2/1979 Neal
4,336,415 A 6/1982 Walling
4,374,530 A 2/1983 Walling
4,476,923 A 10/1984 Walling
4,586,854 A 5/1986 Newman et al.
4,619,323 A 10/1986 Gidley
4,662,437 A 5/1987 Renfro
4,850,812 A 7/1989 Voight
5,158,440 A 10/1992 Cooper et al.
5,169,286 A 12/1992 Yamada
5,180,014 A 1/1993 Cox
5,209,650 A 5/1993 Lemieux
5,261,796 A 11/1993 Niemiec et al.
5,269,377 A 12/1993 Martin
5,285,008 A 2/1994 Sas-Jaworsky et al.
5,334,801 A 8/1994 Mohn
5,360,290 A 11/1994 Yamada et al.
5,494,413 A 2/1996 Campen et al.
5,649,811 A 7/1997 Krol, Jr. et al.
5,797,733 A 8/1998 Falk et al.
5,908,049 A 6/1999 Williams et al.
5,921,285 A 7/1999 Quigley et al.
5,960,875 A * 10/1999 Beauquin ..... E21B 43/128 417/418
6,148,866 A 11/2000 Quigley et al.
6,179,269 B1 1/2001 Kobylinski et al.
6,192,983 B1 2/2001 Neuroth et al.
6,257,332 B1 7/2001 Vidrine et al.
6,286,558 B1 9/2001 Quigley et al.
6,298,917 B1 10/2001 Kobylinski et al.
6,357,485 B2 3/2002 Quigley et al.
6,414,239 B1 7/2002 Gasque, Jr.
6,547,519 B2 4/2003 deBlanc et al.
6,557,642 B2 5/2003 Head
6,604,550 B2 8/2003 Quigley et al.
6,755,609 B2 6/2004 Preinfalk
6,808,371 B2 10/2004 Niwatsukino et al.
6,811,382 B2 11/2004 Buchanan et al.
6,857,452 B2 2/2005 Quigley et al.
6,863,137 B2 3/2005 Terry et al.
7,021,905 B2 4/2006 Torrey et al.
7,033,148 B2 4/2006 Bunner et al.
7,262,532 B2 8/2007 Seidler et al.
7,275,711 B1 10/2007 Flanigan
7,647,948 B2 1/2010 Quigley et al.
7,670,451 B2 3/2010 Head
7,819,640 B2 10/2010 Kalavsky et al.
7,849,928 B2 12/2010 Collie
7,905,295 B2 3/2011 Mack
8,066,033 B2 11/2011 Quigley et al.
8,506,257 B2 8/2013 Bottome
8,905,728 B2 12/2014 Blankemeier et al.
9,028,227 B2 5/2015 Sardet
9,203,277 B2 12/2015 Kori et al.
9,915,256 B2 3/2018 Bebak et al.
10,260,498 B2 4/2019 Knapp
10,443,362 B2 10/2019 Mackay
10,941,778 B2 3/2021 Xiao et al.
11,268,519 B2 3/2022 Melo et al.
11,268,520 B2 3/2022 Melo et al.
2002/0197174 A1* 12/2002 Howard ..... E21B 27/02 417/569
2003/0161739 A1 8/2003 Chu et al.
2003/0185676 A1 10/2003 James
2006/0066169 A1 3/2006 Daugherty et al.
2010/0206577 A1 8/2010 Martinez
2011/0036568 A1 2/2011 Barbosa
2012/0018148 A1 1/2012 Bryant et al.
2012/0263606 A1* 10/2012 Bouldin ..... F04B 47/02 417/54
2013/0300833 A1 1/2013 Perkins
2013/0051977 A1 2/2013 Song
2013/0066139 A1 3/2013 Wiessler
2013/0136639 A1 5/2013 Simpson
2014/0209291 A1 7/2014 Watson et al.
2014/0265654 A1 9/2014 Satterfield
2014/0341714 A1 11/2014 Casa
2015/0192141 A1 7/2015 Nowitzki et al.
2016/0169231 A1 6/2016 Michelassi et al.
2016/0305447 A1 10/2016 Dreiss et al.
2017/0096884 A1 4/2017 Michel
2017/0184097 A1 6/2017 Reeves
2017/0241421 A1 8/2017 Markovitch
2018/0066671 A1 3/2018 Murugan
2018/0171767 A1 6/2018 Huynh et al.
2018/0172020 A1 6/2018 Ejim
2018/0223854 A1 8/2018 Brunvold et al.
2018/0226174 A1 8/2018 Rose
2018/0363660 A1 12/2018 Klahn
2019/0032667 A1 1/2019 Ifrim et al.
2019/0040863 A1 2/2019 Davis et al.
2019/0271217 A1 9/2019 Radov et al.
2020/0355184 A1 12/2020 Xiao et al.

FOREIGN PATENT DOCUMENTS

CN 104141633 11/2014
CN 103835988 1/2016
DE 2260678 6/1974
DE 3022241 12/1981
DE 19654092 7/1998
DE 10307887 10/2004
DE 102007005426 5/2008
DE 102008054766 6/2010
EP 1143104 10/2001
GB 2173034 10/1986
GB 2283035 4/1995
JP 57068599 4/1982
JP S 6189998 5/1986
JP S 62142894 6/1987
JP H 0443814 2/1992
JP H 09254894 9/1997
JP H 109196 1/1998
JP 2005076486 3/2005
JP 2013245569 12/2013
RU 98500 10/2010
RU 178531 4/2018
WO WO 2013171053 11/2013
WO WO 2015084926 6/2015

(56) References Cited

FOREIGN PATENT DOCUMENTS

| | | |
|---|---|---|
| WO | WO 2017021553 | 2/2017 |
| WO | WO 2018022198 | 2/2018 |

OTHER PUBLICATIONS tm4.com [online], "Outer rotor for greater performance," available on or before Dec. 5, 2017, via internet archive: Wayback Machine URL <https://web.archive.org/web/20171205163856/https://www.tm4.com/technology/electric-motors/external-rotor-motor-technology/>, [retrieved on May 17, 2017], retrieved from URL <https://www.tm4.com/technology/electric-motors/external-rotor-motor-technology/>, 2 pages.

Drozdov et al., "The Use of Umbilicals as a New Technology of Artificial-Lift Operation of Oil and Gas Wells without Well Killing when Workover," SPE 160689, Society of Petroleum Engineers (SPE), presented at the SPE Russian Oil & Gas Exploration & Production Technical Conference and Exhibition in Moscow, Russia, Oct. 16-18, 2012, 8 pages.

SAIP Examination Report in Saudi Arabian Appln No. 122440879, dated Mar. 18, 2024, 10 pages.

* cited by examiner

CONTINUOUS MAGNETIC POSITIVE DISPLACEMENT PUMP

TECHNICAL FIELD

This disclosure relates to pumping fluid, and specifically to pumping fluid through wellbores.

BACKGROUND

In many wellbore applications, pumps are used to lift fluids such as hydrocarbons or water from a subterranean zone to the surface from within the wellbore. In some cases, positive displacement pumps are used to provide the lift.

SUMMARY

Certain aspects of the subject matter herein can be implemented as a downhole magnetic pump system. The system includes a tube positioned within a wellbore that is at least partially filled with a fluid. A conductive wire coil is helically wrapped around an outer surface of the tube and is configured to generate a magnetic field in response to an electrical current passing through the coil. The system further includes a standing valve assembly including a one-way valve positioned within the tube, and a travelling valve assembly including a one-way valve positioned in the tube uphole of the standing valve assembly. The traveling valve is axially movable within the tube and is configured to travel in an uphole direction in response to the magnetic field and to repetitively cycle between a first position uphole of the standing valve assembly and a second position uphole of the first position in response to the electrical current repetitively switching between a first state to a second state. In this way, a portion of the fluid is displaced in an uphole direction from a location within the wellbore or the tube downhole of the standing valve assembly to a location within the tube uphole of the traveling valve assembly.

An aspect combinable with any of the other aspects can include the following features. The tube can be or can include coiled tubing.

An aspect combinable with any of the other aspects can include the following features. Switching the electrical current from the first state to the second state can include switching the electrical current on and off.

An aspect combinable with any of the other aspects can include the following features. Switching the electrical current from the first state to the second state can include reversing the electrical current.

An aspect combinable with any of the other aspects can include the following features. The standing valve can include a gripping assembly. Actuation of the gripping assembly can prevent axial movement of the standing valve assembly.

An aspect combinable with any of the other aspects can include the following features. Actuating of the gripping assembly can include displacing a first portion of the standing valve assembly axially towards a second portion of the standing valve assembly in response to the magnetic field.

An aspect combinable with any of the other aspects can include the following features. The first portion of the standing valve assembly can include a magnet.

An aspect combinable with any of the other aspects can include the following features. The traveling valve assembly can include a magnet.

An aspect combinable with any of the other aspects can include the following features. The conductive wire coil can be a lower conductive wire coil and the standing valve assembly and the traveling valve assembly can include a lower valve pair. An upper conductive wire coil helically can be wrapped around the outer surface of the tube uphole of the lower conductive wire coil and can be conductively connected to the first conductive wire coil. An upper valve pair can be positioned in the tube uphole of the lower valve pair. The upper valve pair can include an upper standing valve assembly and an uphole traveling valve assembly. The upper traveling valve assembly can be configured to travel in an uphole direction in response to the magnetic field and to repetitively cycle between a first upper traveling valve assembly position uphole of the upper standing valve assembly and a second upper traveling valve assembly position uphole of the first upper traveling valve assembly position in response to the electrical current repetitively switching between the first state and the second state. A portion of the fluid can be therefore displaced in an uphole direction from a location within the tube downhole of the upper standing valve assembly to a location within the tube uphole of the upper traveling valve assembly.

Certain aspects of the subject matter herein can be implemented as a downhole pump. The pump includes a tube configured to be positioned within a wellbore and having a downhole end and an uphole end and a conductive wire coil helically wrapped around an outer surface of the tube and configured to generate, in response to an electrical current passing through the coil, a magnetic field. The pump further includes a standing valve assembly positioned within the tube and comprising a first one-way valve, and a travelling valve assembly positioned in the tube between the standing valve assembly and the uphole end and comprising a second one-way valve. The traveling valve is axially movable within the tube and is configured to travel towards the uphole end in response to the magnetic field and to repetitively cycle between a first position proximate the standing valve assembly and a second position closer to the uphole end than the first position in response to the electrical current repetitively switching between a first state to a second state. A fluid is thereby displaced through the tube from the downhole end to the uphole end.

An aspect combinable with any of the other aspects can include the following features. The traveling valve assembly can include a magnet.

Certain aspects of the subject matter herein can be implemented as a method. The method includes positioning a tube within a wellbore that is at least partially filled with a fluid. A conductive wire coil is helically wrapped around an outer surface of the tube and the coil is configured to generate, in response to an electrical current passing through the coil, a magnetic field. The method also includes positioning in the tube a standing valve assembly comprising a first one-way valve, and positioning a traveling valve assembly in the tube. The traveling valve includes a second one-way valve and is configured to travel axially relative to the standing valve assembly in response to the magnetic field. The method further includes repetitively cycling the electrical current between a first state and second state, thereby repetitively cycling the traveling valve assembly between a first position uphole of the standing valve assembly and a second position uphole of the first position, and thereby displacing a portion of the fluid in an uphole direction from a location within the wellbore or the tube downhole of the standing valve assembly to a location within the tube uphole of the traveling valve assembly.

An aspect combinable with any of the other aspects can include the following features. The tube can be or can include coiled tubing.

An aspect combinable with any of the other aspects can include the following features. Switching the electrical current from the first state to the second state can include switching the electrical current on and off.

An aspect combinable with any of the other aspects can include the following features. Switching the electrical current from the first state to the second state can include reversing the electrical current.

An aspect combinable with any of the other aspects can include the following features. Positioning the standing valve assembly in the tube can be after the positioning the tube within the wellbore.

An aspect combinable with any of the other aspects can include the following features. Positioning the standing valve assembly in the tube is can be before positioning the tube within the wellbore.

An aspect combinable with any of the other aspects can include the following features. A gripping assembly of the standing valve assembly can be actuated to prevent axial movement of the standing valve assembly within the tube.

An aspect combinable with any of the other aspects can include the following features. Actuating of the gripping assembly can include displacing a first portion of the standing valve assembly axially towards a second portion of the standing valve assembly in response to the magnetic field.

An aspect combinable with any of the other aspects can include the following features. The first portion of the standing valve assembly can include a magnet.

An aspect combinable with any of the other aspects can include the following features. The traveling valve assembly can include a magnet.

An aspect combinable with any of the other aspects can include the following features. The conductive wire coil can be a lower conductive wire coil and the standing valve assembly and the traveling valve assembly can include a lower valve pair. An upper conductive wire coil conductively connected to the first conductive wire coil can be helically wrapped around the outer surface of the tube uphole of the lower conductive wire coil. An upper valve pair can be positioned in the tube uphole of the lower valve pair. The upper valve pair can include an upper standing valve assembly and an uphole traveling valve assembly, and the upper traveling valve assembly can be configured to travel in an uphole direction in response to the magnetic field. The method can further include repetitively cycling the upper traveling valve assembly between a first upper traveling valve assembly position uphole of the upper standing valve assembly and a second upper traveling valve assembly position uphole of the first upper traveling valve assembly position in response to the electrical current repetitively switching between the first state and the second state. In this way, a portion of the fluid is displaced in an uphole direction from a location within the tube downhole of the upper standing valve assembly to a location within the tube uphole of the upper traveling valve assembly.

An aspect combinable with any of the other aspects can include the following features. The method can further include actuating a gripping assembly of the lower standing valve assembly to prevent axial movement of the lower standing valve assembly by displacing a first portion of the lower standing valve assembly axially towards a second portion of the lower standing valve assembly in response to the magnetic field. The method can further include actuating a gripping assembly of the upper standing valve assembly to prevent axial movement of the standing valve assembly by displacing a first portion of the upper standing valve assembly axially towards a second portion of the upper standing valve assembly in response to the magnetic field.

An aspect combinable with any of the other aspects can include the following features. The tube can be or can include coiled tubing.

The details of one or more implementations of the disclosure are set forth in the accompanying drawings and the description that follows. Other features, objects, and advantages of the disclosure will be apparent from the description and drawings, and from the claims.

DETAILED DESCRIPTION

The present disclosure is directed to a downhole pumps used in artificial lift systems.

Downhole pumps are widely used for pumping oil, water, or other liquids from wellbores. Such pumps can be utilized as part of an artificial lift system or for other applications. Artificial lift systems generally comprise of a string of tubing or pipe known as a production string that suspends the downhole pump device near the bottom of the well bore proximate to the producing formation. The downhole pump is used to retrieve production zone fluid, impart a higher pressure into the fluid and discharge the pressurized production zone fluid into production tubing. Pressurized well bore fluid rises towards the surface motivated by difference in pressure.

In accordance with an embodiment of the present disclosure, a downhole pump system includes a positive displacement pump that is operated by cycling an electric current through a coil around the outside of a tube, thereby moving a traveling valve assembly within the tube up and down relative to a standing valve assembly. The system may have fewer moving components than a conventional system and can minimize frictional losses downhole. The system can reduce or eliminate the need for surface stuffing boxes or other surface equipment, thereby reducing or eliminating certain risks such as leak hazards or equipment malfunction, particularly in the presence of corrosive fluid components such as $H_2S$. The pump of the present system can be assembled with the tube at the surface either at the wellsite or at another surface location, and/or can be assembled or partially assembled after placing the tube in the wellbore. The system can be deployed along with, or in a similar fashion as with, coiled tubing applications, and can provide uninterrupted deployment, i.e. fewer or no pauses to screw additional sections of tubing or rods.

Figure 1:
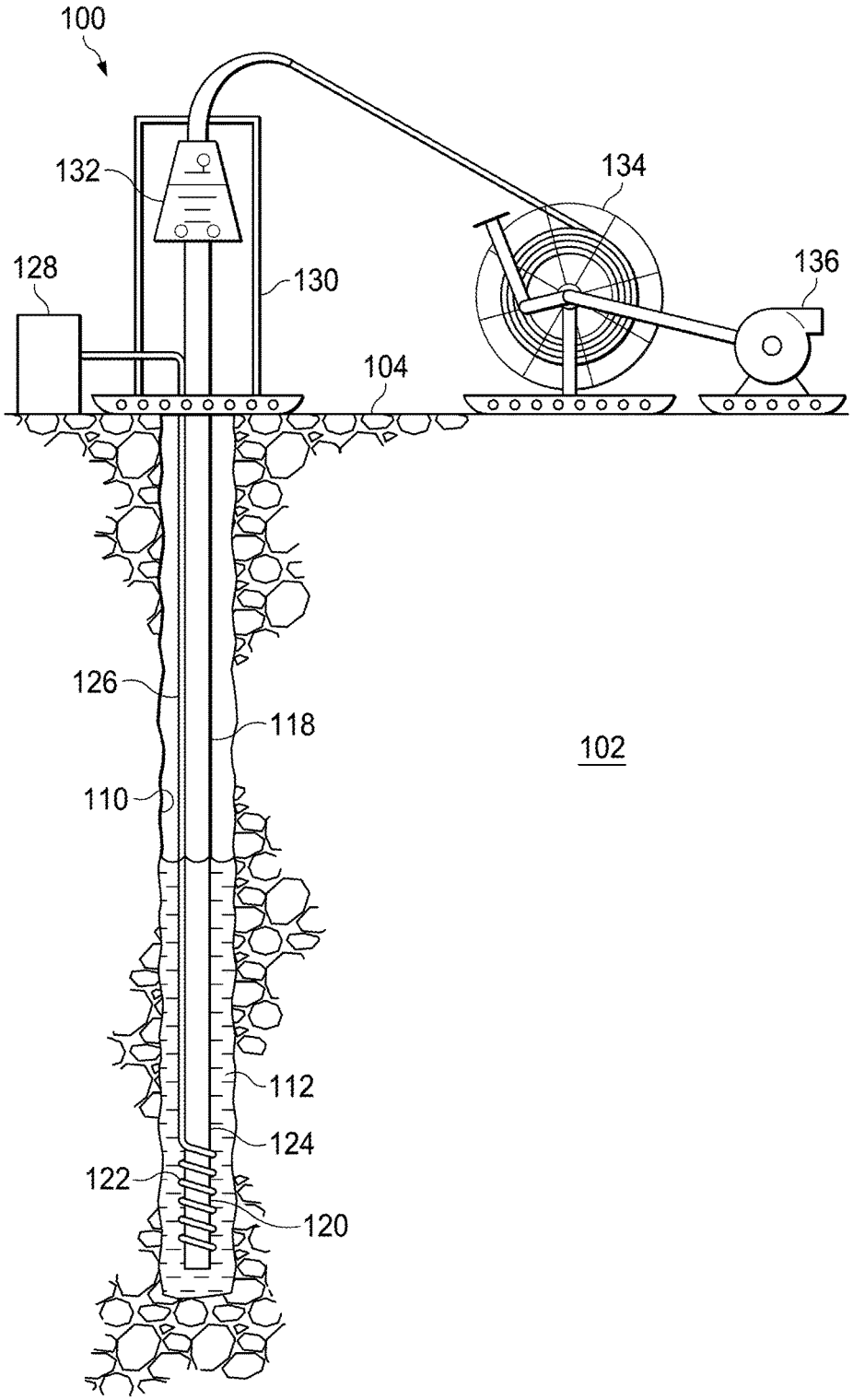
FIG. 1 is a schematic diagram of a downhole pump system in accordance with an embodiment of the present disclosure.

FIG. 1 is a schematic diagram of a downhole pump system in accordance with an embodiment of the present disclosure. Referring to FIG. 1, wellbore 110 has been drilled into a subterranean zone 102 from surface 104. Surface tubing 118 is positioned within wellbore 110 and can comprise a continuous length of coiled tubing, or can comprise separate pipe segments connected to each other, or another suitable tubing. Surface tubing 118 can be composed of steel or another suitable metal, plastic, elastomer, composite, or a combination of these materials, as may be suitable for the particular operational environment. In the illustrated embodiment, surface tubing 118 is coiled tubing deployed via injector 132 within wellhead assembly 130 from reel 134. In other embodiments, surface tubing 118 can be deployed using other suitable methods.

Wellbore 110 can be an oil and/or gas well, water well, or other wellbore drilled into subterranean zone 102 for purposes of oil and/or gas production, water extraction, geothermal resource exploitation, or other purpose or application, and can be drilled from a surface (land) location or an offshore location. Wellbore 110 can be a substantially vertical well or can be other-than-vertical (such as substantially horizontal), and/or can include both vertical and other-than-vertical (such as substantially horizontal) portions, and can comprise a single wellbore or can include multiple lateral wellbores. Wellbore 110 is at least partially filled with a fluid 112. Fluid 112 can be, for example, oil, gas, water, or a mixture of different fluids.

Pump 120 is connected to surface tubing 118 at the downhole end of surface tubing 118. Pump 120 includes a pump tube 124. In some embodiments, pump tube 124 and surface tubing 118 are not separate tube segments but instead are part of one continuous tubing such as continuous coiled tubing. In other embodiments, pump tube 124 can be a separate tube segment connected to the bottom end of surface tubing 118, via a threaded connection or other suitable connection. Like surface tubing 118, pump tube 124 can be composed of steel or another suitable metal, plastic, elastomer, composite, or a combination of these materials, as may be suitable for the particular operational environment. A downhole end of pump 120 (along with some or all of the remaining length of pump 120) is immersed within fluid 112.

A conductive wire coil 122 is helically wrapped around an outer surface of pump tube 124. A conductive control wire 126 conductively connects the wire coil 122 to a control module 128. As described in more detail in reference to FIGS. 2-4, wire coil 122 is configured to generate a magnetic field in response to an electric current flowing control wire 126. Pump 120 also includes a standing valve assembly and a travelling valve assembly (not shown in FIG. 1 but shown and described in more detail in FIGS. 2, 3, and 4A-4D) positioned within tube 118, each of which includes a one-way valve. In the illustrated embodiment, control module 128 is positioned at a surface location. In other embodiments, control module 128 can be positioned at a subsurface location (for example, within wellbore 110).

In some embodiments, coil 122 and control wire 126 are formed from a single conductive wire strand. In other embodiments, coil 122 and control wire 126 are formed from separate wire strands in conductive communication. Coil 122 and control wire 126 can be composed of copper, aluminum, or another suitable conductive material.

Control module 128 can comprise computer system comprising one or more processors and a non-transitory computer-readable medium storing computer instructions executable by the one or more processors to perform operations. The operations can comprise transmitting current through control wire 126 and to coil 122. Control module 128 can alternate the current on or off and/or reverse the current, either in response to direct instructions from an operator or as part of a programmed sequence. As described in more detail in reference to FIGS. 2, 3, and 4A-4D, coil 122 is configured as a solenoid which generates a magnetic field in response to the flow of current. The magnetic field causes the traveling valve to move in an uphole direction. The traveling valve can return to the initial position in response to turning off (or reversing) the current. Repetitively switching the current on and off, or repetitively reversing the current, can thus cycle the traveling valve up and down, thereby displacing fluid in an uphole direction from a location downhole of the standing valve assembly within wellbore 110 (and/or, within pump tube 124) and/or to a location within pump tube 124 (and/or surface tubing 118) uphole of the traveling valve assembly. In this way, such repeated cycling acts to pump the fluid in an uphole direction within surface tubing 118. The pumped fluid can then be transported from surface tubing 118 to a suitable surface location (such as a tank, pipeline system, or other suitable repository). In the illustrated embodiment, surface pump 136 effectuates the transfer of the pumped fluid from tubing 118 to the suitable repository.

Figure 2:
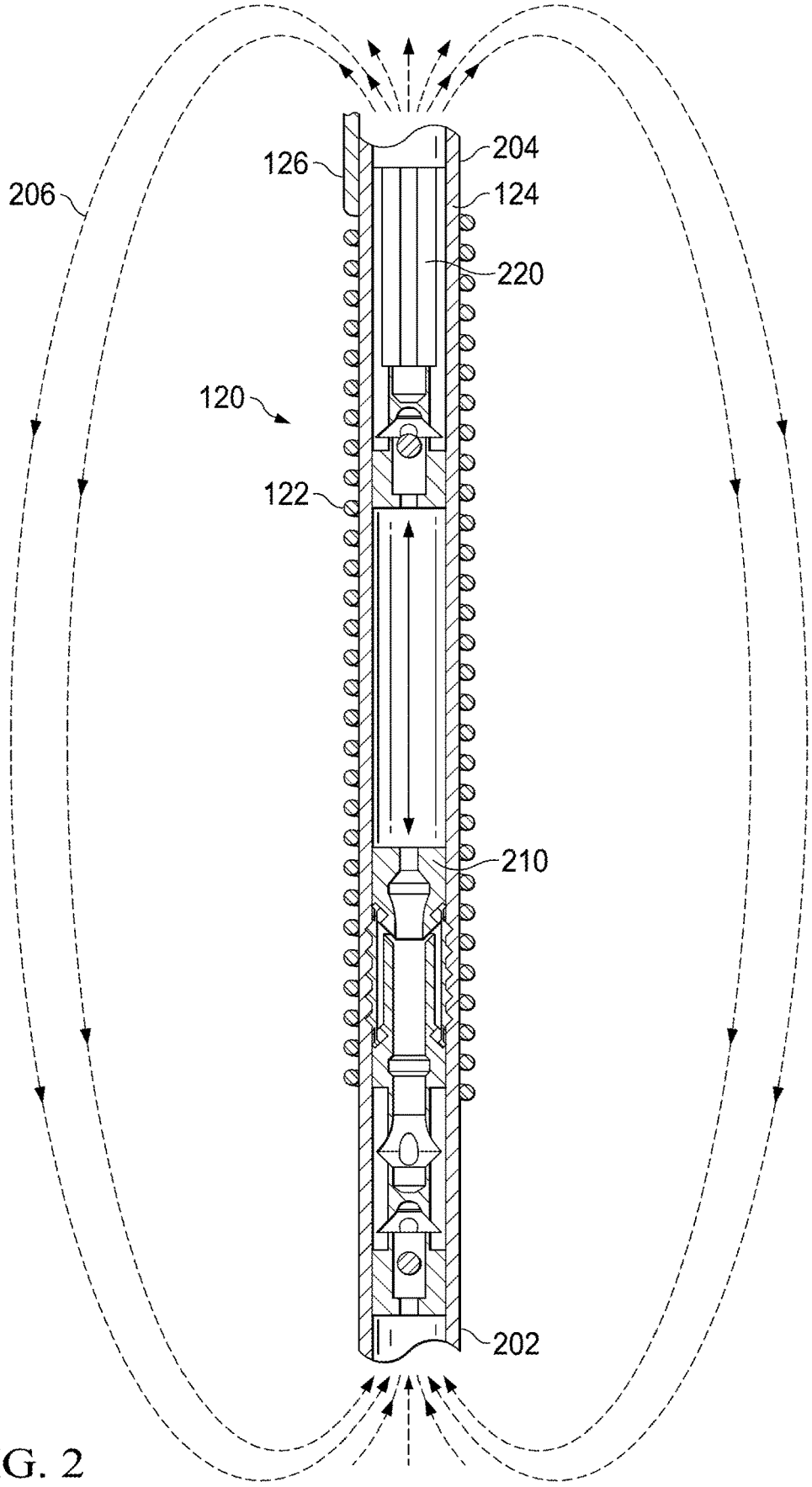
FIG. 2 is a schematic diagram of a downhole pump in accordance with an embodiment of the present disclosure.

FIG. 2 is a schematic diagram of downhole pump 120 of FIG. 1 in accordance with an embodiment of the present disclosure. Referring to FIG. 2, pump 120 includes pump tube 124 (described above in reference to FIG. 1) and a downhole end 202 and an uphole end 204. Pump 120 (or, at least downhole end 202 of pump 120) can be immersed in a fluid (such as wellbore fluid 112 of FIG. 1).

Referring to FIG. 2, pump 120 includes conductive wire coil 122 is helically wrapped around an outer surface of tube 124 which, as described above in reference to FIG. 1, can act as a solenoid such that it can generate a magnetic field 206 in response to an electrical current passing through coil 122. Pump 120 also includes standing valve assembly 210 positioned within tube 124. As described in more detail in reference to FIG. 3, standing valve assembly 210 includes a one-way valve and a gripper assembly (such as a grips or slips) to prevent axial movement of standing valve assembly 210 within tube 124. Pump 120 also includes a travelling valve assembly 220 positioned in the tube 121 between standing valve assembly 210 and uphole end 204. Traveling valve assembly 220 includes a one-way valve and can move (travel) up and down (i.e., in an uphole direction and in a downhole direction) axially within tube 124. Traveling valve assembly 220 is configured to travel in an uphole direction towards uphole end 204 in response to magnetic field 206 (as generated due to current traveling down conductive wire 126 as initiated by control unit 128 (FIG. 1), and then back down in a downhole direction towards standing valve assembly 210 in response to the removal or reversal of magnetic field 206. The one-way valves of standing valve assembly 210 and standing valve assembly 220 can permit fluid flow in an uphole direction (i.e., in the direction from downhole end 202 towards uphole end 204) but prevent fluid flow in the opposite (downhole) direction. The travel of traveling valve assembly 220 in the downhole direction can be due to gravity and/or due to the reversal of magnetic field 206. Thus, traveling valve assembly 220 can cycle between a first position (such as, for example a position wherein traveling valve assembly 220 rests on or is proximate to (i.e., positioned immediately above) standing valve assembly 210) and a second position closer to the uphole end than the first position in response to the electric current through coil 122 switching between a first state (i.e., current off or flowing in a first direction) and a second state (i.e., current on or reversed to flow in a second direction). Repetitively cycling the current between the first state and the second state therefore repetitively cycles the traveling valve assembly 220 between the first position and the second position. Because the one-way valves only permit fluid flow in the uphole direction, such cycling displaces fluid through tube 124 from the downhole end 202 to the uphole end 204.

Figure 3:
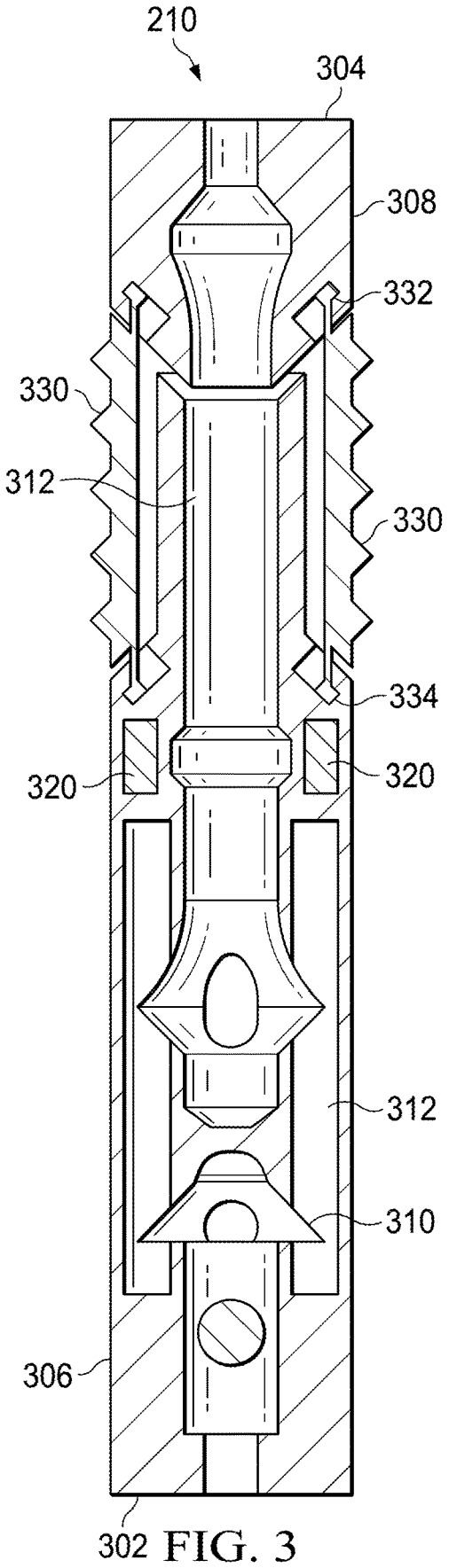
FIG. 3 is a schematic diagram of a standing valve assembly of a downhole pump in accordance with an embodiment of the present disclosure.

FIG. 3 is a schematic diagram of a standing valve assembly 210 of downhole pump 120 in accordance with an embodiment of the present disclosure. In the illustrated embodiment, standing valve assembly 210 includes a lower end 302 and an upper end 304 and is divided between a lower portion 306 and a separate upper portion 308. In some embodiments, the standing valve assembly does not have separate upper and lower portions but instead has a single main body portion. One-way valve 310 allows fluid to flow in an upwards direction (from lower end 302 towards upper end 304) through fluid passage 312.

Standing valve assembly 210 also includes a gripping assembly 330. Gripping assembly 330 can include one or more grips or slips that, when actuated (for example, pushed radially in an outward direction) can grip an inner surface of a tube within which standing valve assembly 210 is positioned. In the illustrated embodiment, lower portion 306 can be a female end and upper portion 308 can be a male end, such axial movement of lower portion 306 and upper portion 308 towards each other lower portion 30 into upper portion 308 or within each other causes axially gripping assembly 330 to extend radially in an outward direction. In the illustrated embodiment, lower portion 306 is composed of a metallic and/or magnetic material and/or includes one or more magnets 320, such that application of magnetic field 206 (shown in FIG. 2) causes such axial movement (i.e., causes lower portion 306 to travel in the upward direction relative to upper portion 308) due to the solenoid effect. In some embodiments, relative movement of upper portion 308 can be limited by rubber baffles or other suitable means to further effectuate the axial compression caused by upwards movement of lower portion 306. In this way, gripping assembly 330 can be act actuated by flowing electric current through conductive wire 126 and coil 122 (FIG. 2).

In some embodiments, a pump system (such as pump system 100 with pump 120 of FIGS. 1 and 2) can be assembled after insertion of surface tubing 118 into a wellbore by dropping standing valve assembly 210 into the tubing and allowing it to fall (and/or be pumped down to) to a suitable position (for example a position within pump tube 124) at which time gripping assembly 330 can be actuated by flowing electric current through coil 122, thereby fixing standing assembly 210 in position and preventing further axial movement. The traveling valve assembly 210 can thereafter be dropped through the tubing and will land on top of (i.e., uphole of) the standing valve assembly. In other embodiments, standing valve assembly 210 (and/or traveling valve assembly 220) can be inserted and positioned using other methods (such as slickline) and gripping assembly 330 actuated using different (or additional) methods, such as via mechanical push or pull or rotation, hydraulic force, pressure, or other suitable methods.

Figure 4A:
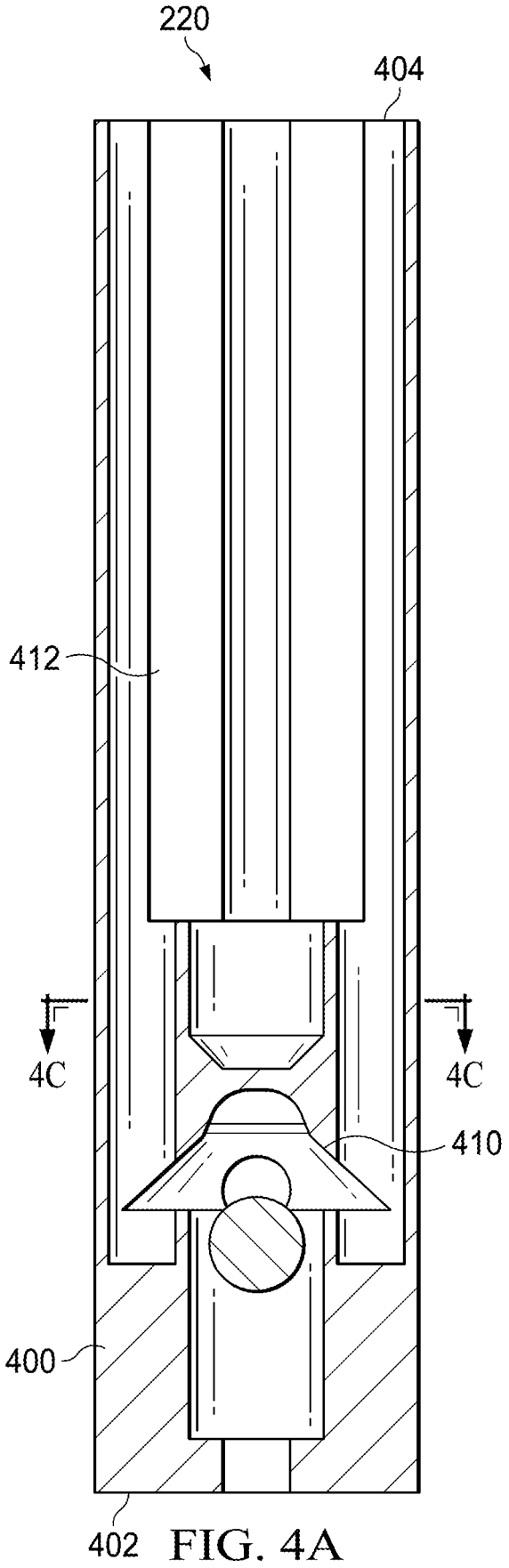
FIGS. 4A-4D are schematic diagrams of a traveling valve assembly of a downhole pump in accordance with an embodiment of the present disclosure.
Figure 4B:
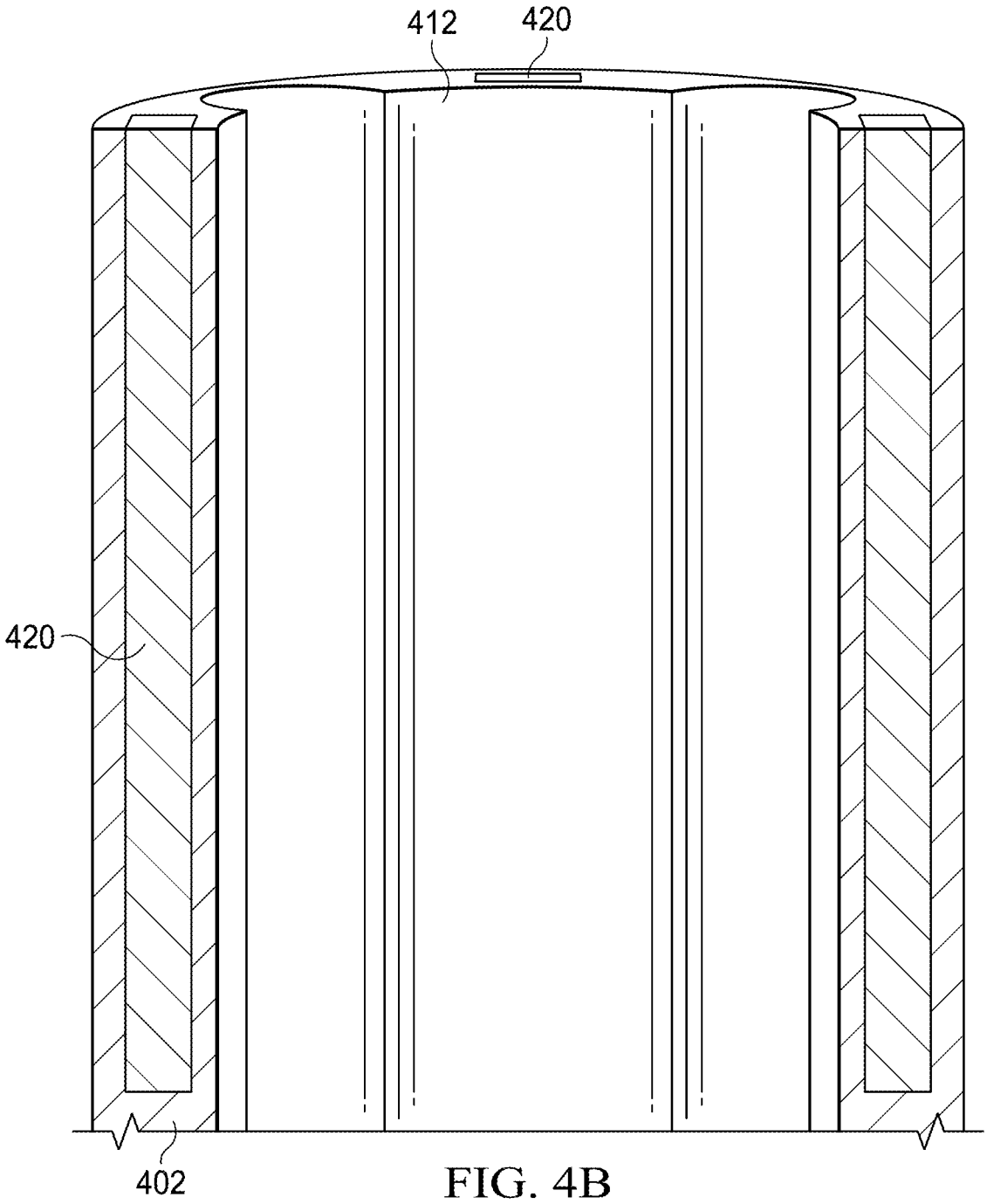
Figure 4C:
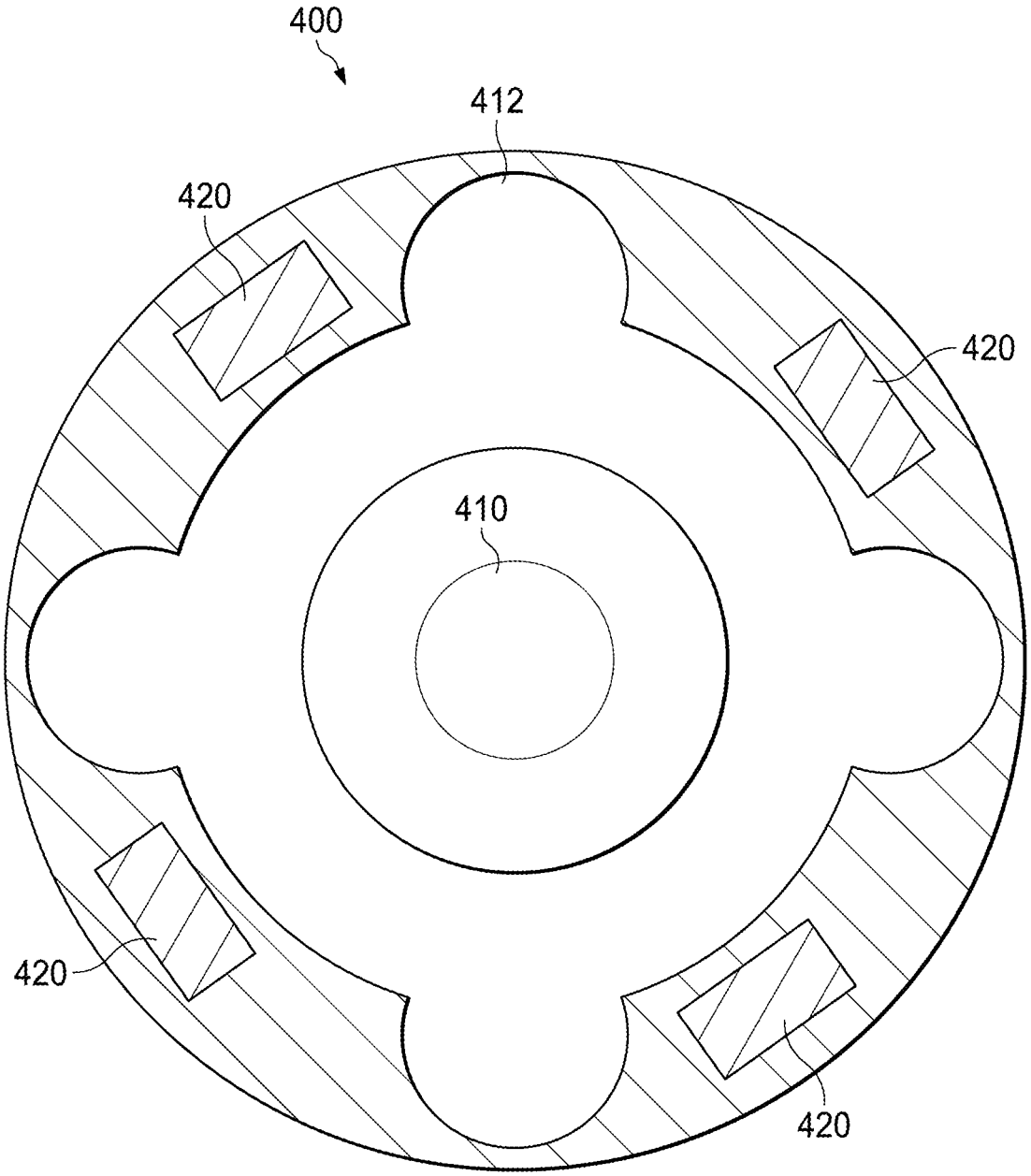
Figure 4D:
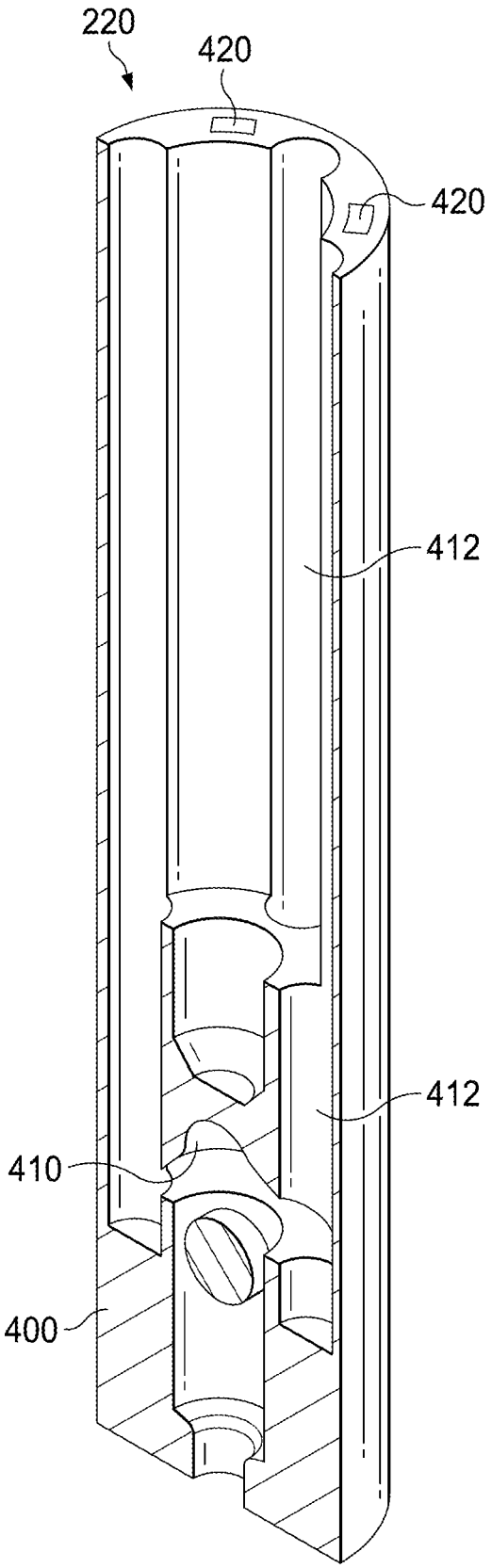

FIGS. 4A-4D are schematic diagrams of a traveling valve assembly 220 of downhole pump 120 in accordance with an embodiment of the present disclosure. Referring to FIG. 4A, travelling valve assembly 220 includes a main body 400 and a lower end 402 and an upper end 404. One-way valve 410 allows fluid to flow in an upwards direction (from lower end 402 towards upper end 404) through fluid passage 412. In some embodiments, main body 400 is composed of a metallic and/or magnetic material. In some embodiments, instead of or in addition to having a magnetic main body, one or more magnets 420 (as shown in FIGS. 4B-4D). Application of magnetic field 206 to the magnets or magnetic material causes axial movement of traveling valve assembly 220 due to the solenoid effect, as shown in FIG. 2. FIGS. 4B, 4C and 4D are a cross-sectional views of traveling valve assembly 220 in an embodiment in which a plurality of magnets 420 are arranged circumferentially within main body 400 around one-way valve 410 and fluid passage 412. Other embodiments can include other configurations of magnets 420 and/or fluid passage 412 within main body 400.

Figure 5:
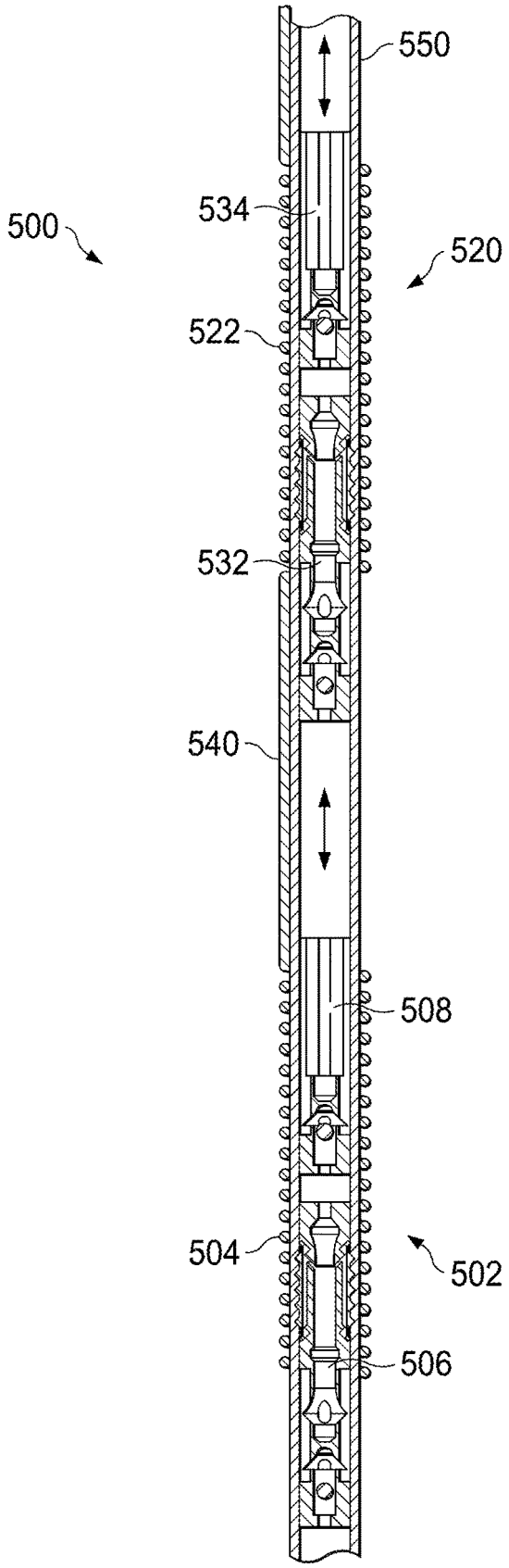
FIG. 5 is a schematic diagram of a downhole pump system with multiple downhole pumps in accordance with an embodiment of the present disclosure.

FIG. 5 is a schematic diagram of a downhole pump system 500 with multiple downhole pumps in accordance with an embodiment of the present disclosure. Downhole pump system 500 can be positioned within a wellbore, similar to pump system 100 of FIG. 1.

Referring to FIG. 5, lower downhole pump 502 is a lower pump that includes (lower) conductive wire coil 504, (lower) standing valve assembly 506, and (lower) traveling valve assembly 508, which are similar in design and function as wire coil 122, standing valve assembly 210, and traveling valve assembly 220 of FIGS. 1, 2, 3, and 4A-4B, respectively.

Pump system 500 also includes an upper downhole pump 520 that includes (upper) conductive wire coil 522, (upper) standing valve assembly 532, and (upper) traveling valve assembly 534, which again are similar in design and function as wire coil 122, standing valve assembly 210, and traveling valve assembly 220 of FIGS. 1, 2, 3, and 4A-4B, respectively.

In the illustrated embodiment, both lower coil 504 and upper coil 522 are connected by a single conductive wire 540 which (like wire 126 of FIG. 1) is connected to a surface or subsurface control module which can transmit electrical current through wire 540. Similar to as described above, repetitively switching the current on and off, or repetitively reversing the current, can simultaneously cycle both lower traveling valve 508 and upper traveling valve assembly 534 up and down, thereby displacing fluid in an uphole direction. In other embodiments, lower coil 504 and upper coil 522 are connected to control module via separate conductive wires, such that the upper and lower traveling valves can be cycled independently (for example, successively). In some embodiments, simultaneous cycling can provides the advantage of only one wire 540 being required to actuated multiple pumps. However having all pumps actuating simultaneously can in some circumstances limit the control over the amount of produced fluid and pressure, since fluid properties change as pressure changes. In some embodiments, independent control of each unit can require multiple wires 540 but will allow to control flow and pressure generated by each pump which can optimize the production efficiency.

Figure 6:
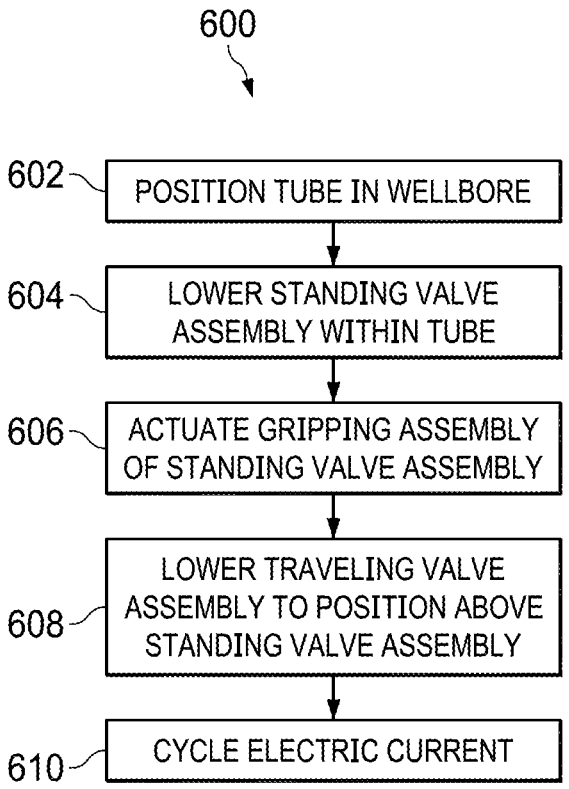
FIG. 6 is a process flow diagram of a method of operating a downhole pump in accordance with an embodiment of the present disclosure.

FIG. 6 is a process flow diagram of a method 600 of operating a downhole pump in accordance with an embodiment of the present disclosure. Method 600 begins at step 602 wherein a tube is positioned within a wellbore at least partially filled with a fluid. The tube includes a conductive wire coil is helically wrapped around its outer surface. The coil is configured to generate, in response to an electrical current passing through the coil, a magnetic field.

Proceeding to step 604, a standing valve assembly that includes a one-way valve is positioned within the tube. In some embodiments, the standing valve assembly is positioned in the tube after the tube is positioned in the wellbore; in other embodiments, the standing valve assembly is positioned in the tube before the tube is positioned in the wellbore. In some embodiments, the decision of whether to place the standing valve assembly the tube before insertion of the tube in the wellbore or after insertion of the tube in the wellbore can be made at the wellsite.

Proceeding to step 606, when the standing valve assembly reaches a desired or suitable location, the gripping assembly of the standing valve assembly is actuated, thereby fixing the standing valve assembly at that location and or limiting further axial movement of the standing valve assembly.

Proceeding to step 608, a traveling valve assembly is positioned in the tube. The traveling valve includes a second one-way valve and is configured to travel axially relative to the standing valve assembly in response to the magnetic field.

Proceeding to step 610, the electrical current is cycled on and off (or between a first current direction and a second current direction), thereby repetitively cycling the traveling valve assembly between a first position uphole of the standing valve assembly and a second position uphole of the first position. In this way, a portion of the fluid is displaced in an uphole direction from a location within the wellbore or the tube downhole of the standing valve assembly to a location within the tube uphole of the traveling valve assembly.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A downhole magnetic pump system, comprising:

a tube positioned within a wellbore, the wellbore at least partially filled with a fluid;

a conductive wire coil helically wrapped around an outer surface of the tube and configured to generate, in response to an electrical current passing through the conductive wire coil, a magnetic field;

a standing valve assembly positioned within the tube and comprising a first one-way valve, the standing valve assembly comprising a first portion configured to remain stationary within the tube and a second portion configured to axially move towards and away from the first portion;

a travelling valve assembly comprising a second one-way valve and positioned in the tube uphole of the standing valve assembly, the travelling valve assembly axially movable within the tube and configured to travel in an uphole direction in response to the magnetic field and to repetitively cycle between a first position uphole of the standing valve assembly and a second position uphole of the first position in response to the electrical current repetitively switching between a first state and a second state, thereby displacing a portion of the fluid in the uphole direction from a location within the wellbore or the tube downhole of the standing valve assembly to a location within the tube uphole of the travelling valve assembly.

2. The system of claim 1, wherein the tube comprises a coiled tubing.

3. The system of claim 1, wherein switching the electrical current from the first state to the second state comprises switching the electrical current between off and on.

4. The system of claim 1, wherein switching the electrical current from the first state to the second state comprises reversing the electrical current.

5. The system of claim 1, wherein the standing valve assembly comprises a gripping assembly and wherein an actuation of the gripping assembly prevents an axial movement of the first portion of the standing valve assembly within the tube.

6. The system of claim 5, wherein the first portion and the second portion are configured such that an axial movement of the first portion and the second portion towards each other causes the gripping assembly to grip an inner surface of the tube.

7. The system of claim 6, wherein the first portion of the standing valve assembly comprises a magnet.

8. The system of claim 1, wherein the travelling valve assembly comprises a magnet.

9. The system of claim 1, wherein the conductive wire coil is a lower conductive wire coil and the standing valve assembly and the travelling valve assembly comprise a lower valve pair, the system further comprising:

an upper conductive wire coil helically wrapped around the outer surface of the tube uphole of the lower conductive wire coil and conductively connected to the lower conductive wire coil;

an upper valve pair positioned in the tube uphole of the lower valve pair, the upper valve pair comprising an upper standing valve assembly and an upper travelling valve assembly, the upper travelling valve assembly configured to travel in an uphole direction in response to the magnetic field and to repetitively cycle between a first upper travelling valve assembly position uphole of the upper standing valve assembly and a second upper travelling valve assembly position uphole of the first upper travelling valve assembly position in response to the electrical current repetitively switching between the first state and the second state, thereby displacing the portion of the fluid in the uphole direction from a location within the tube downhole of the upper standing valve assembly to a location within the tube uphole of the upper travelling valve assembly.

10. The system of claim 1, wherein the first portion of the standing valve assembly is a male portion and the second portion of the standing valve assembly is a female portion.

11. A downhole pump comprising:

a tube configured to be positioned within a wellbore and having a downhole end and an uphole end;

a conductive wire coil helically wrapped around an outer surface of the tube and configured to generate, in response to an electrical current passing through the conductive wire coil, a magnetic field;

a standing valve assembly positioned within the tube and comprising a first one-way valve, the standing valve assembly comprising a first portion configured to remain stationary within the tube and a second portion configured to axially move towards and away from the first portion;

a travelling valve assembly positioned in the tube between the standing valve assembly and the uphole end and comprising a second one-way valve, the travelling valve assembly axially movable within the tube and configured to travel towards the uphole end in response to the magnetic field and to repetitively cycle between a first position proximate the standing valve assembly and a second position closer to the uphole end than the first position in response to the electrical current repetitively switching between a first state and a second state, thereby displacing a fluid through the tube from the downhole end to the uphole end.

12. The downhole pump of claim 11, wherein the travelling valve assembly comprises a magnet.

13. A method comprising:

positioning a tube within a wellbore, the wellbore at least partially filled with a fluid, wherein a conductive wire coil is helically wrapped around an outer surface of the tube and the coil is configured to generate, in response to an electrical current passing through the conductive wire coil, a magnetic field;

positioning in the tube a standing valve assembly comprising a first one-way valve, the standing valve assembly comprising a first portion configured to remain stationary within the tube and a second portion configured to axially move towards and away from the first portion;

positioning a travelling valve assembly in the tube, the travelling valve assembly comprising a second one-way valve and configured to travel axially relative to the standing valve assembly in response to the magnetic field; and repetitively switching the electrical current between a first state and a second state, thereby repetitively cycling the travelling valve assembly between a first position uphole of the standing valve assembly and a second position uphole of the first position, thereby displacing a portion of the fluid in an uphole direction from a location within the wellbore or the tube downhole of the standing valve assembly to a location within the tube uphole of the travelling valve assembly.

14. The method of claim 13, wherein the tube comprises a coiled tubing.

15. The method of claim 13, wherein switching the electrical current from the first state to the second state comprises switching the electrical current off and on.

16. The method of claim 12, wherein switching the electrical current from the first state to the second state comprises reversing the electrical current.

17. The method of claim 13, wherein positioning the standing valve assembly in the tube is after positioning the tube within the wellbore.

18. The method of claim 13, wherein positioning the standing valve assembly in the tube is before positioning the tube within the wellbore.

19. The method of claim 13, further comprising actuating a gripping assembly of the standing valve assembly to prevent axial movement of the first portion of the standing valve assembly within the tube.

20. The method of claim 19, wherein the actuating of the gripping assembly comprises displacing the second portion of the standing valve assembly axially towards the first portion of the standing valve assembly in response to the magnetic field.

21. The method of claim 20, wherein the second portion of the standing valve assembly comprises a magnet.

22. The method of claim 19, wherein, in response to actuating, the gripping assembly is pushed radially in an outward direction.

23. The method of claim 13, wherein the travelling valve assembly comprises a magnet.

24. The method of claim 13, wherein the conductive wire coil is a lower conductive wire coil and the standing valve assembly and the travelling valve assembly comprise a lower valve pair, and wherein:

an upper conductive wire coil conductively connected to the lower conductive wire coil is helically wrapped around the outer surface of the tube uphole of the lower conductive wire coil; and an upper valve pair is positioned in the tube uphole of the lower valve pair, the upper valve pair comprising an upper standing valve assembly and an uphole travelling valve assembly, the upper travelling valve assembly configured to travel in an uphole direction in response to the magnetic field;

and wherein the method further comprises repetitively cycling the upper travelling valve assembly between a first upper travelling valve assembly position uphole of the upper standing valve assembly and a second upper travelling valve assembly position uphole of the first upper travelling valve assembly position in response to the electrical current repetitively switching between the first state and the second state, thereby displacing the portion of the fluid in the uphole direction from a location within the tube downhole of the upper standing valve assembly to a location within the tube uphole of the upper travelling valve assembly.

* * * * *